United States Patent [19]

Mann

[11] Patent Number: 5,058,950

[45] Date of Patent: Oct. 22, 1991

[54] FOLDABLE CHAIR

[76] Inventor: Amiram Mann, 16 Oppenheimer St., Tel-Aviv, Israel

[21] Appl. No.: 607,986

[22] Filed: Nov. 1, 1990

[30] Foreign Application Priority Data

Nov. 5, 1989 [IL] Israel ..... 92213

[51] Int. Cl.[5] ..... A47C 4/28

[52] U.S. Cl. ..... 297/45; 297/16; 297/35

[58] Field of Search ..... 297/16, 17, 31, 35, 297/39, 44, 45, 46

[56] References Cited

U.S. PATENT DOCUMENTS 703,077 6/1902 Nivison ..... 297/45

3,136,272 6/1964 Sprigman ..... 297/45 X 4,118,065 10/1978 Watkins ..... 297/45

4,124,188 11/1978 Machen ..... 297/45 X 4,243,263 1/1981 Thiboutot ..... 297/45 X

*Primary Examiner*—Laurie K. Cranmer

*Attorney, Agent, or Firm*—Norbert P. Holler

[57] ABSTRACT

A foldable chair comprising a pair of front legs, a pair of rear legs, and linkage systems interconnecting the legs. The chair is characterized in that each linkage system consists of a pair of compass-like frame members and a respective pair of crosswise extending link arms. The linkage system is designed so that when the chair is in its folded position it forms into a compact package whereby the legs extend in close parallel relative positions.

11 Claims, 4 Drawing Sheets

FOLDABLE CHAIR

BACKGROUND OF THE INVENTION

The present invention relates to foldable chairs of the type comprised of a lightweight tubular support frame and canvas sheet seat and back-rest upholstery, for use at sea shores, recreation sites, etc., whereby the chairs are easily converted from a neatly folded package portable storage position into a comfortable, unfolded service position.

The invention provides for chairs of this kind, specially designed to minimize the storage space requirement, thereby facilitating portability.

These goals are accomplished by designing the chairs to achieve a complex, three-dimensional folding; i.e. when folding the chair, all four legs converge and approach one another, in a tripod-like fashion, becoming compacted into a neat elongated package. The folded package may be easily carried under one's arm or within a suitable sheath similar to a golfbag.

SUMMARY OF THE INVENTION

Thus, according to a general aspect of the invention there is provided a foldable chair comprising a pair of front legs and a pair of rear' legs and linkage systems interconnecting the legs, characterised in that each linkage system consists of a pair of pivotally interconnected frame members and a respective pair of diagonally mutually crosswise extending link arms, so that the chair is foldable into a compact package wherein the legs extend in close, parallel relative positions.

The linkage systems that connect the front legs and the rear legs to each other are preferably located at a lower and at a higher level, respectively, the rods of the last mentioned linkage system serving as arm-rests of the chair.

These and several other constructional features of the invention will become more clear in light of the following description of a preferred embodiment of the invention, given by way of example only with reference to the accompanying drawings.

DETAILED DESCRIPTION OF THE PREFERRED EMBODIMENT

Figure 1:
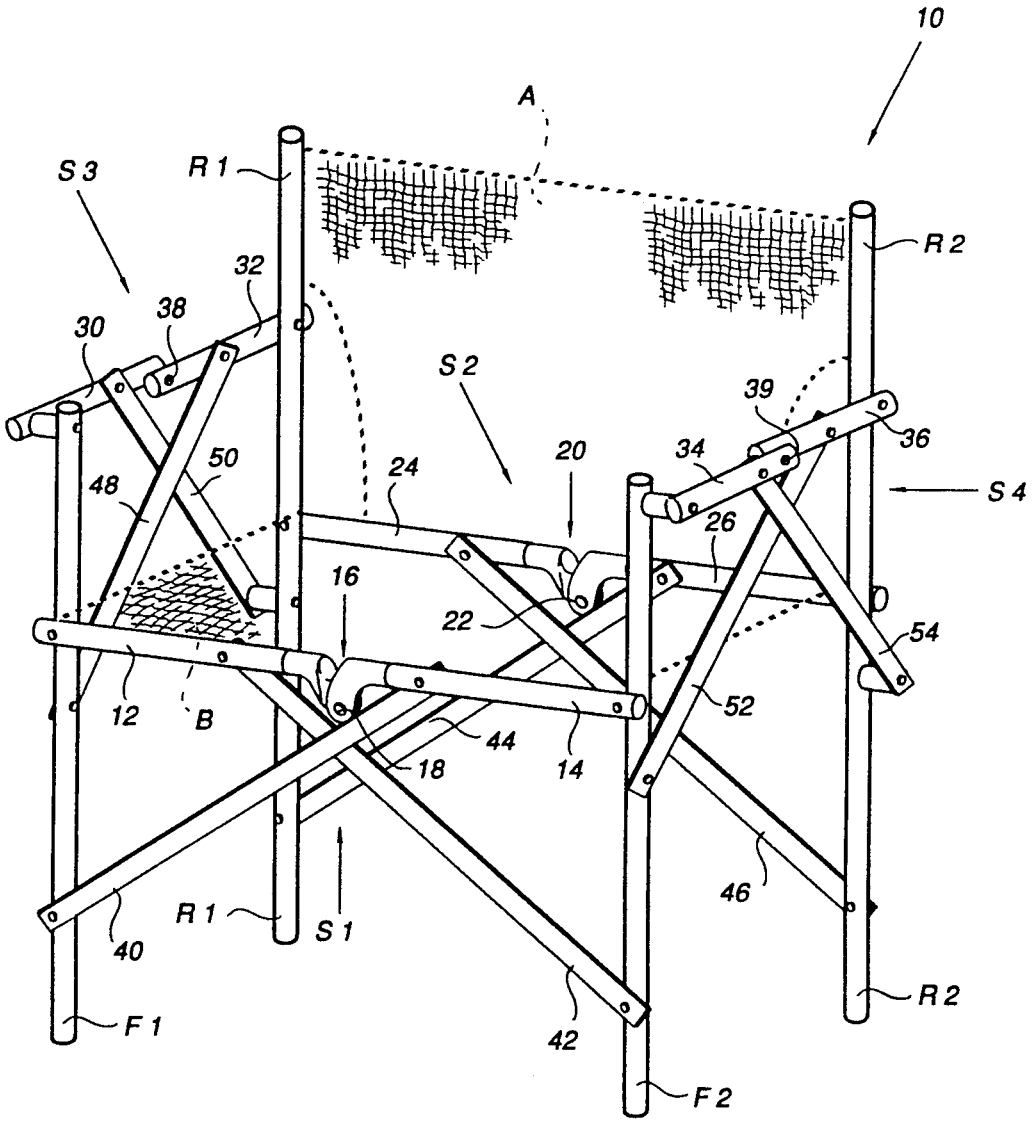
FIG. 1 is a three-dimensional representation of. a chair embodying the features of the present invention.

As shown in FIG. 1, the chair, generally denoted 10 is comprised of a pair of front legs F1 and F2, and a pair of rear legs R1 and R2, the rear legs being longer than the front legs to allow the mounting of a back rest canvas sheet A, preferably made as an extension to seat rest canvas sheet denoted B, as shown in phantom lines in FIG. 1. However, the chair 10 may also be designed as an ordinary stool without a back rest.

There are further provided four substantially identical linkage systems: Front legs linkage system denoted S1; rear legs linkage system, denoted S2; rightside linkage system, denoted S3; and leftside linkage system, denoted S4.

The system S1 comprises tubular link rods 12 and 14 of identical length, connected to each other in a foldable fashion, namely pivotally connected to each other at their proximate ends so as to be angularly displaceable relative to one another from a folded position in which they are relatively closely adjacent each other to an unfolded position in which they are juxtapositioned end to end one to the other. The link rods are generally made of lightweight metal such as aluminum alloy. However, other suitable materials, like plastic, may be used.

Figure 4:
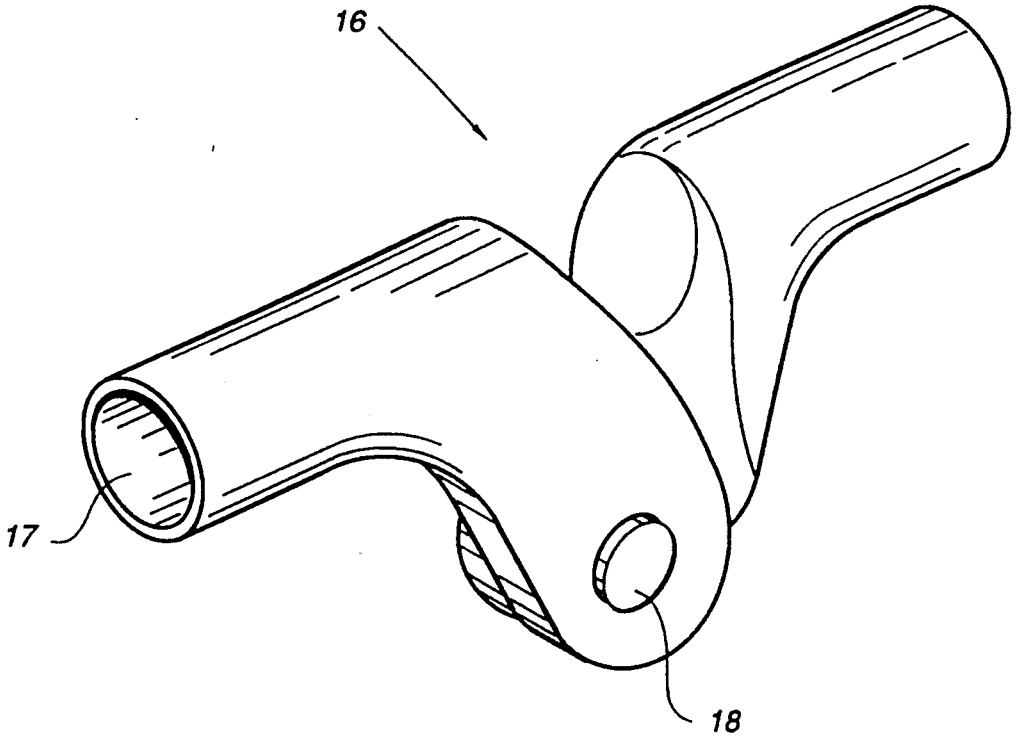
FIG. 4 shows a connector for a pair of frame rods.

The rods extend in a common plane and therefore interconnect by a connector device denoted 16, preferably made of molded plastic and having for each rod a socket portion 17 for receiving one end of the respective rod and a flange portion for a pivot pin 18, as is best seen in FIG. 4.

A similar coupling arrangement is provided with respect to the rear linkage system S2 namely comprising a dual socket and flange type connector 20, having a pivot pin 22 for pivotally and foldably interconnecting a pair of frame rods 24 and 26.

Figure 2:
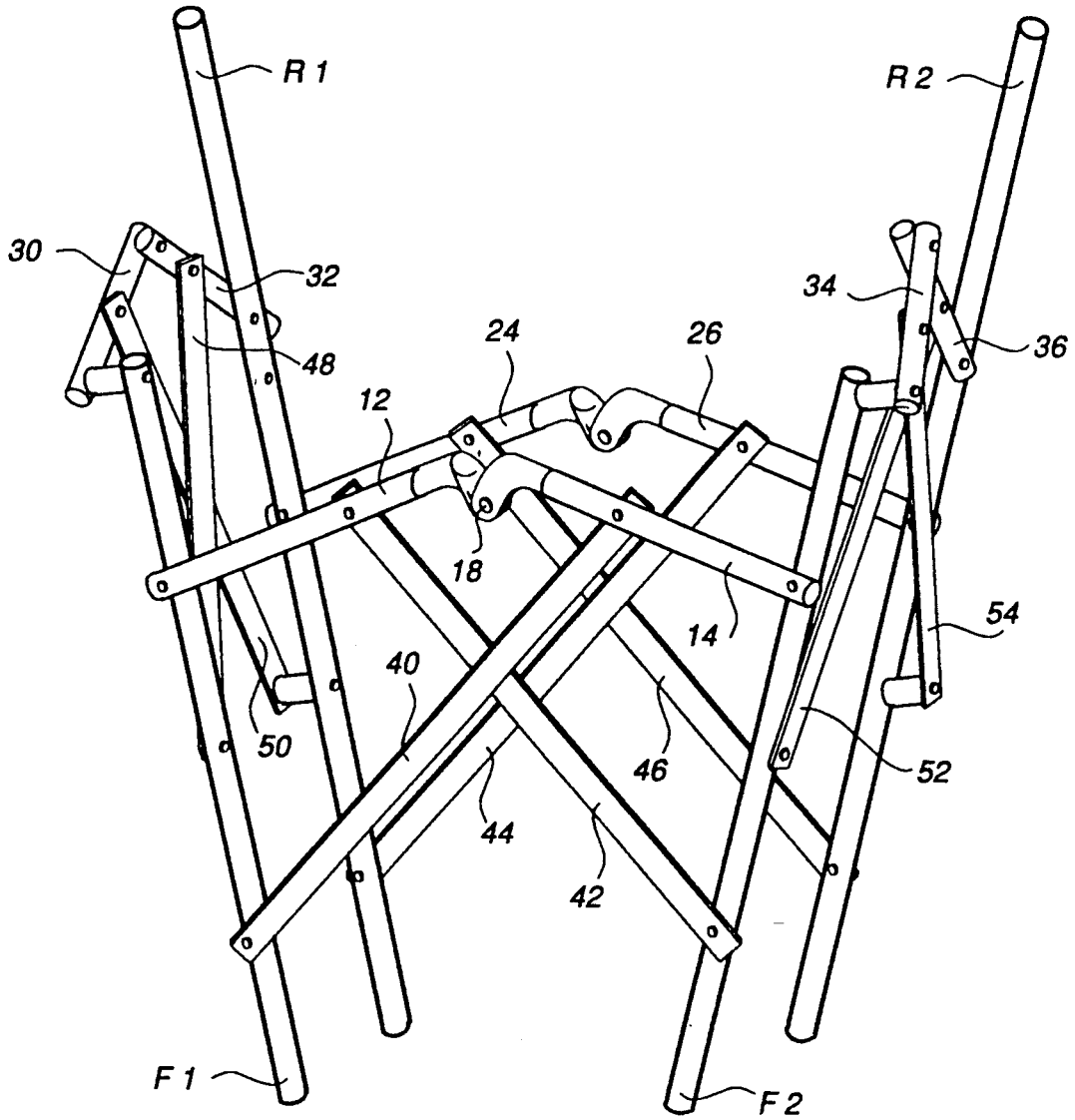
FIG. 2 shows the chair of FIG. 1 in a partly folded stage.

The side frame systems S3 and, S4 comprise foldably interconnected frame rods 30 and 32 at the one side and 34 and 36 at the other side, however, these are pivotally connected to each other by respective pivot pins 38 and 39, as shown in FIGS. 1 and 2 rather than by intermediate connectors such as 16 or 20.

For each of the linkage systems S1–S4 a pair of crossing link arms are provided, namely arms 40 and 42 for the pair of front legs F1 and F2, 44 and 46 for the rear legs R1 and R2, 48 and 50 for the rightside legs F1 and R1, and 52 and 54 for the leftside pair of legs F2 and R2. The link arms are pivoted to their respective frame rods, as shown, keeping a strict geometrical identical relationship therebetween, being a requisite for obtaining the folding capability of the structure as a unitary interlinked skeleton.

Figure 3:
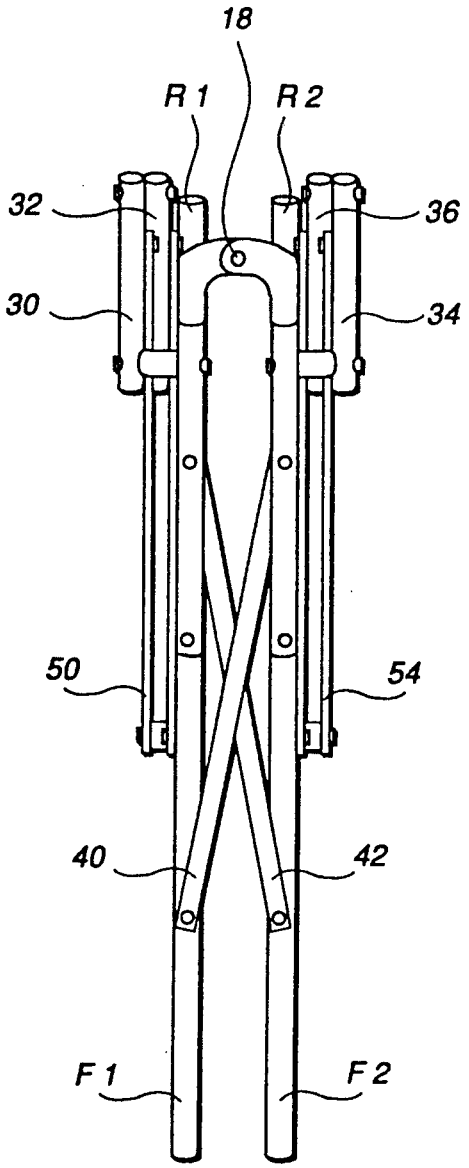
FIG. 3 shows the chair of FIG. 1 in a final folded stage.

It will be now evident that the structural features as above described allow the chair 10 to fold in a unique manner to a finally compact elongated package shown in FIG. 3 whereby all four legs approach each other in the direction of the central axis of symmetry. However, as can be seen, the bottom extremities of the various pairs of next adjacent legs are not interconnected by foldable frame members corresponding to the frame members 12–14, 24–26, 30–32 and 34–36. As a consequence, the linkage arrangement of the present invention ensures that during the folding operation the legs of the chair do not remain parallel while they approach each other; rather, at the start only the bottom extremities of the legs are shifted toward the center line or axis of symmetry of the chair while the top extremities remain extended, as shown in FIG. 2, and only thereafter are the latter shifted toward the center line of the chair and into the position shown in FIG. 3.

The package can then be easily carried under one arm or placed in a suitable bag for space-efficient storage in a car trunk, closet, or elsewhere.

Those skilled in the art will readily appreciate that the exemplified embodiment of the chair may be changed or modified in various respects without departing from the scope of the invention as defined in and by the appended claims.

What is claimed is:

1. A foldable chair including a pair of front legs and a pair of rear legs and a plurality of linkage systems each interconnecting a respective one of the legs and an associated next adjacent leg, wherein the improvement comprises that each linkage system consists essentially of a pair of elongated frame members foldably pivotally connected to one another at respective first ends thereof and each pivotally connected at a second end thereof to a respective one of the associated legs, and a pair of mutually crosswise extending link arms each pivotally connected at a first end thereof to a respective first one of said associated legs and at a second end thereof to an intermediate portion of the respective one of said frame members which is connected to the second one of said associated legs, whereby the chair is foldable into a compact package in which the legs extend in close, parallel relative positions.

2. A foldable chair as claimed in claim 1 wherein the linkage system connecting the front legs to each other and the linkage system connecting the rear legs to each other are located at a first level above the bottom extremities of the legs, and the linkage systems connecting the respective front legs to the rear legs are located at a second, higher level.

3. A foldable chair as claimed in claim 2 wherein the foldably connected frame members of each of the linkage systems at the first level serve, when in their unfolded state, as a seat-rest canvas sheet anchorage.

4. A foldable chair as claimed in claim 3 wherein the foldably connected frame members of each of the linkage systems at the second level serve, when in their unfolded state, as arm-rests.

5. A foldable chair as claimed in claim 4 wherein the legs and the foldably connected frame members are formed of tubular rods and the link arms are formed of flat bars.

6. A foldable chair as claimed in claim 5 wherein the tubular rods of each of the front and rear linkage systems connecting the front legs to each other and the rear legs to each other are pivotally connected to each other by means of respective intermediate joint members constructed and arranged so that the said tubular rods of each of said front and rear linkage systems extend in a respective common plane.

7. A foldable chair as claimed in claim 6 wherein the joint members are of molded plastic.

8. A foldable chair as claimed in claim 6 wherein the tubular rods of each of the right and left side linkage systems connecting the front legs to the respective rear legs are pivotally connected to each other by means of respective pivot joints constructed and arranged so that each of the tubular rods of each side linkage system extends in a plane parallel to and laterally offset from the plane of the other tubular rod of the same side linkage system.

9. A foldable chair as claimed in claim 1 wherein the rear legs are longer than the front legs, the portions of the rear legs which extend above the level of the upper extremities of the front legs serving as a back-rest canvas anchorage.

10. A foldable chair as claimed in claim 1 wherein the frame members of each of the front and rear linkage systems connecting the front legs to each other and the rear legs to each other are pivotally connected to each other by means of respective intermediate joint members constructed and arranged so that the frame members of each of said front and rear linkage systems extend in a respective common plane.

11. A foldable chair as claimed in claim 10, wherein the frame members of each of the right and left side linkage systems connecting the front legs to the respective rear legs are pivotally connected to each other by means of respective pivot joints constructed and arranged so that each of the frame members of each side linkage system extends in a plane parallel to and laterally offset from the plane of the other frame member of the same side linkage system.

* * * * *